US005850061A

United States Patent [19]

Klompenhouwer et al.

[11] Patent Number: 5,850,061

[45] Date of Patent: Dec. 15, 1998

[54] GENERATOR SOUND SHIELD

[75] Inventors: Greg D. Klompenhouwer; James L. King, both of Sheboygan, Wis.

[73] Assignee: Kohler Co., Kohler, Wis.

[21] Appl. No.: 889,681

[22] Filed: Jul. 8, 1997

Related U.S. Application Data

[60] Provisional application No. 60/021,690 Jul. 10, 1996.

[51] Int. Cl.[6] ..... F01N 1/10; B65D 7/30

[52] U.S. Cl. ..... 181/202; 181/204; 220/4.34

[58] Field of Search ..... 181/200, 202, 181/203, 204, 205; 220/4.28, 4.31, 4.32, 4.34

[56] References Cited

U.S. PATENT DOCUMENTS 1,443,688 1/1923 Hurd .
3,276,539 10/1966 Dear et al. .
3,478,958 11/1969 Hink, III et al. .
3,784,043 1/1974 Presnick ..... 220/4.34
4,629,031 12/1986 Kato et al. .
4,733,750 3/1988 Poirier et al. .
4,747,248 5/1988 Fahs .
4,914,929 4/1990 Shimazaki .
4,928,470 5/1990 Perez .

*Primary Examiner*—Khanh Dang
*Attorney, Agent, or Firm*—Quarles & Brady

[57] ABSTRACT

An acoustical enclosure for an engine generator set which can be easily assembled and disassembled, as well as assembled and disassembled in close quarters. The assembly and disassembly can be accomplished without special tools. The enclosure is constructed in a manner to afford a change in size or configuration without a change in tooling. The rail/frame construction allows removal of side, end and top panels thus simplifying maintenance.

7 Claims, 7 Drawing Sheets

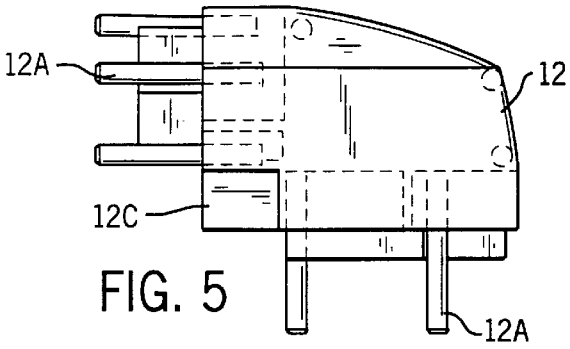
FIG. 5
FIG. 6
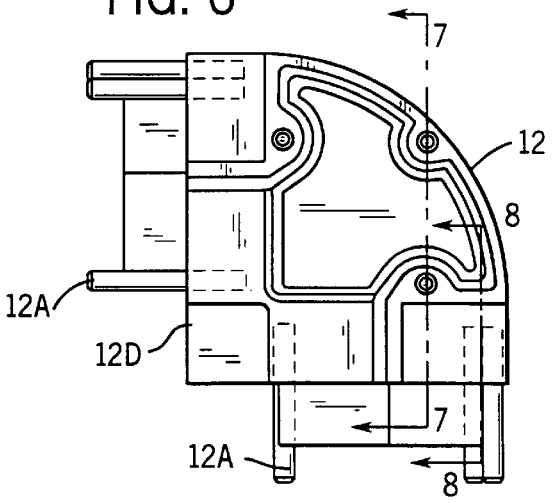
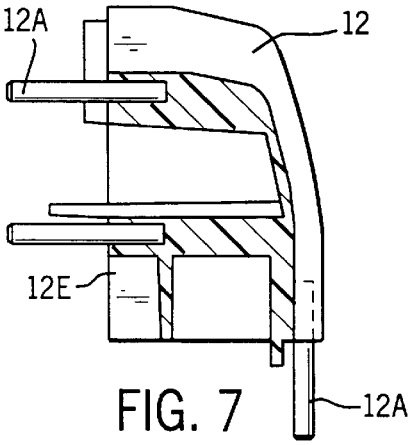
FIG. 7
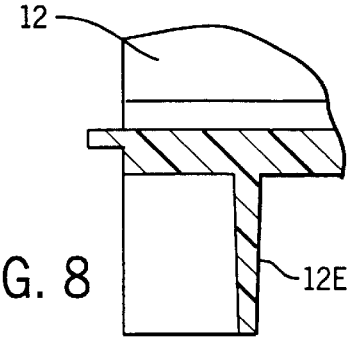
FIG. 8
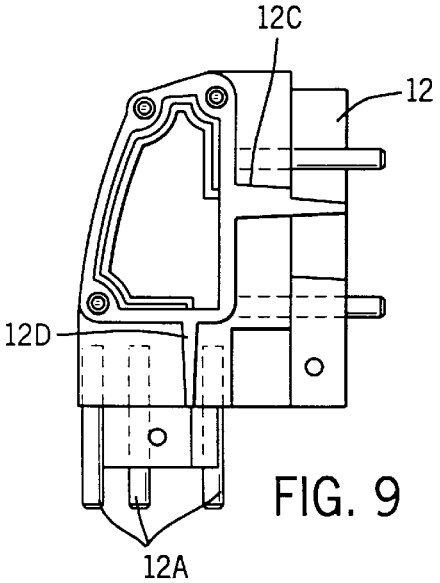
FIG. 9
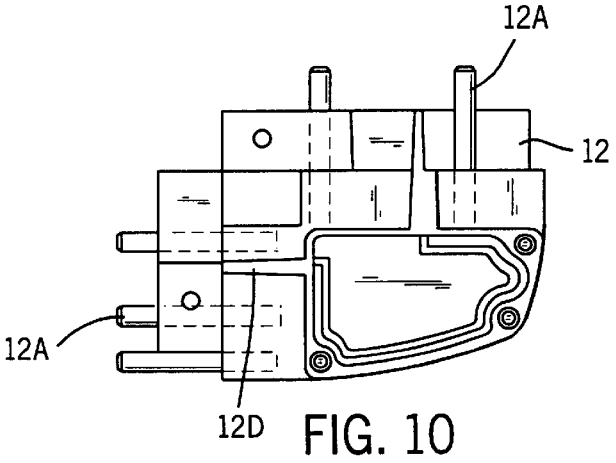
FIG. 10

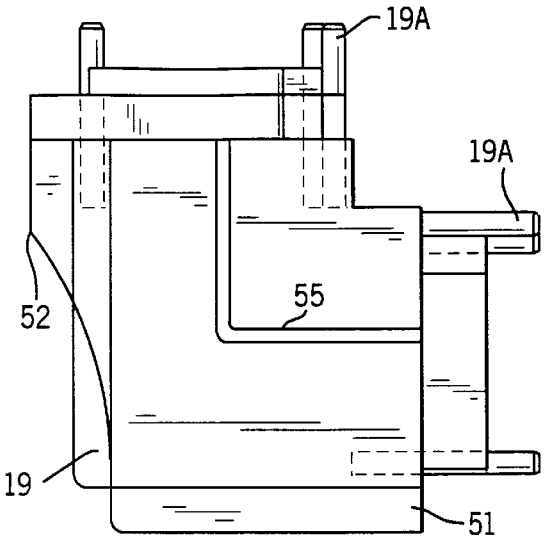
FIG. 11
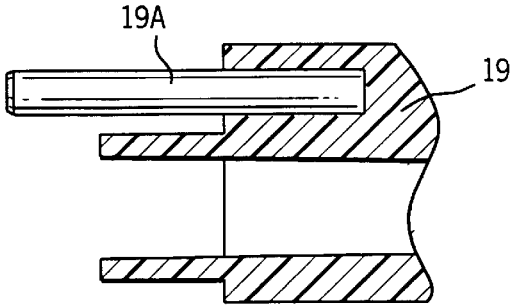
FIG. 13
FIG. 12
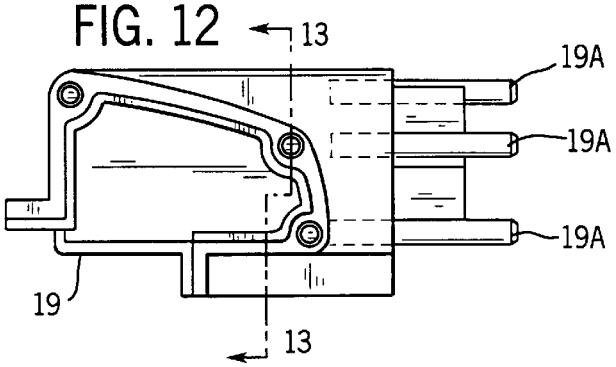
FIG. 14
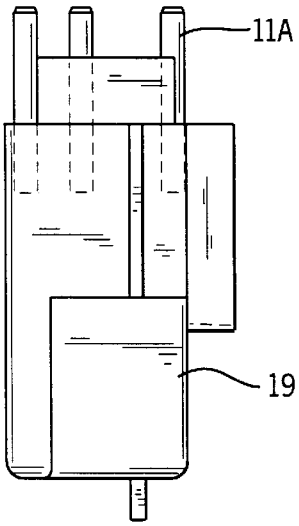
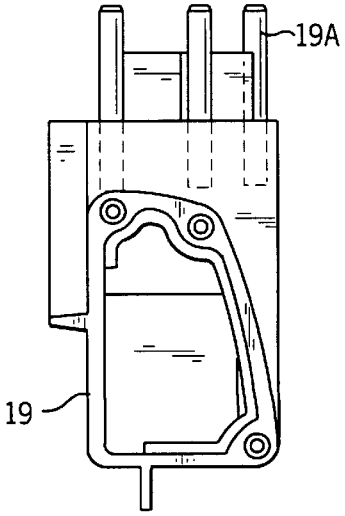
FIG. 15
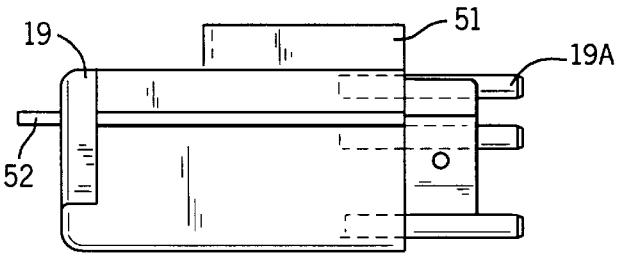
FIG. 16

GENERATOR SOUND SHIELD

CROSS-REFERENCE TO RELATED APPLICATIONS

This application is a continuation-in-part of provisional application Ser. No. 60/021,690 filed Jul. 10, 1996.

STATEMENT REGARDING FEDERALLY SPONSORED RESEARCH OR DEVELOPMENT (Not Applicable)

BACKGROUND OF THE INVENTION

This invention relates to a sound shield for a generator, and particularly to a shield in the form of a box or container which can be constructed from corner connectors to connect top and side rails with the rails providing attachment of panels.

Electric generators are by their nature noisy as they are powered by an internal combustion engine. It is therefore desirable to have a sound shield which can enclose the engine and generator. It is further desirable to have such a sound shield which can be constructed with few component parts which also afford versatility in the size of the shield, as well as its manner of construction.

Corner connectors for assembling panel sections are well known. These are shown in U.S. Pat. Nos. 4,928,470 and 4,747,248. The use of pins and apertures to assembly housing members is illustrated in U.S. Pat. No. 4,914,929. However, the prior art does not disclose an easily assembled enclosure which can be assembled in close quarters.

SUMMARY OF THE INVENTION

In one aspect, the invention provides an acoustical enclosure for an engine generator set wherein a plurality of rail members are constructed and arranged when assembled to form a frame for an enclosure, the rail members having notches in the ends thereof. There are a plurality of connector members for interconnecting ends of the rail members to form the frame. Connector pin members extend from the connector members for engaging the notches of the rail members in a manner to provide a slide-together and a slide-apart disconnection. A plurality of panel members are connected to the rail members to provide the enclosure whereby the acoustical enclosure can be readily assembled and disassembled in close quarters.

In another aspect, a generator sound shield construction is provided that can be used for Marine, Standby, Prime and Mobile applications. It has initially been designed for the marine generator market. The unique design concept is its expansibility to allow easy change in size with no change in tooling. In its most basic sound shield form it is a rectangular box. It is constructed using four outside molded plastic or cast aluminum corner connectors. Four extruded or molded top rail members are connected by the connector members and four side rail members need only be square cut to the proper length and pushed on to three of the nine drive pins in the corner connector members. The assembled rail members will then enclose a rectangular frame box with a top opening and four side openings. In its most common construction the bottom of the frame side rail members will be mounted and affixed to generator skid rails. When connected to a generator set skid rail, a sound shield frame will have five openings that can have panel members installed. The side panel members can be of any adequate material such as aluminum, steel, plastic, fiberglass or any material that can be formed into a structurally rigid sound absorbing panel.

In a preferred embodiment, the generator sound shield has six outer connector members and two inner connector members to provide connection for thirteen rail members and seven panel members.

BRIEF DESCRIPTION OF THE DRAWINGS

FIG. 5 is a top view of one of the connectors employed in conjunction with the generator sound shield shown in FIGS. 1–4;

FIG. 6 is a side view of the connector shown in FIG. 5;

FIG. 7 is a sectional view taken along line 7—7 of FIG. 6;

FIG. 8 is a sectional view taken along line 8—8 of FIG. 6;

FIG. 9 is a side view of the connector shown in FIG. 5;

FIG. 10 is a bottom view of the connector shown in FIG. 5;

FIG. 11 is a side view of another connector employed in conjunction with the generator sound shield shown in FIGS. 1–4;

FIG. 12 is a top view of the connector shown in FIG. 11;

FIG. 13 is a sectional view taken along line 13—13 of FIG. 12;

FIG. 14 is an end view of the connector shown in FIG. 11;

FIG. 15 is a view similar to FIG. 12 of an opposing side;

FIG. 16 is a bottom view of the connector shown in FIG. 16;

DESCRIPTION OF THE PREFERRED EMBODIMENT

Figure 1:
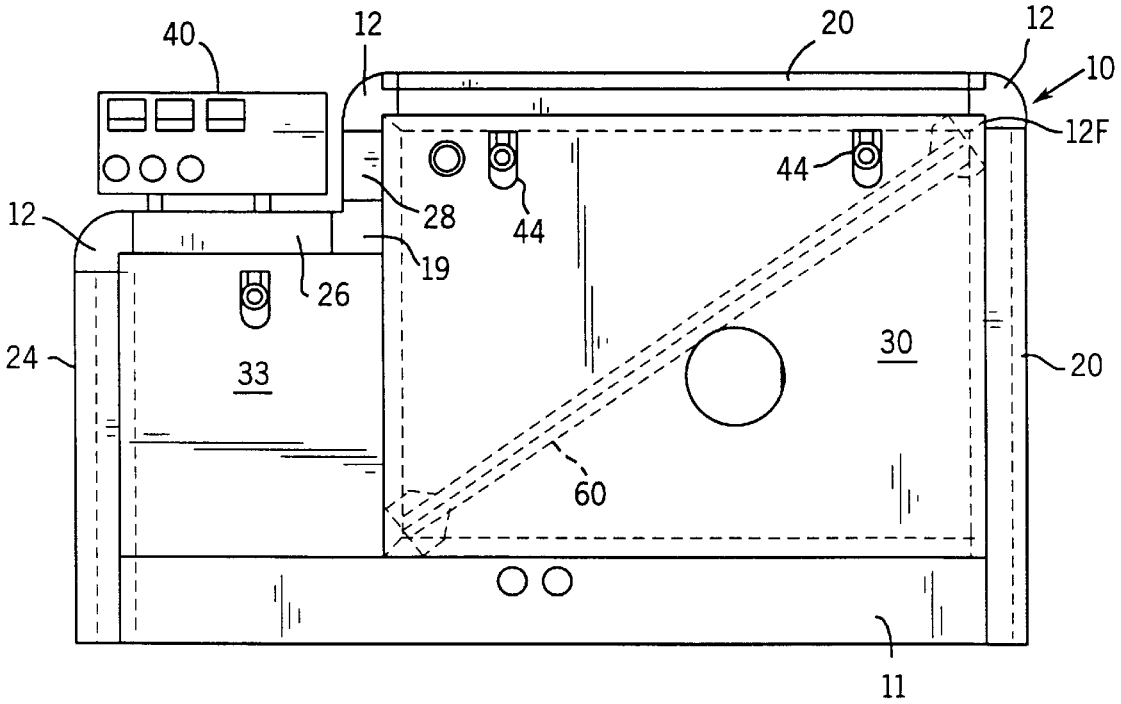
FIG. 1 is a front view in elevation of the generator sound shield in accordance with the invention.

Referring to FIGS. 1–4, the generator sound shield, generally 10, is shown in conjunction with a skid rail 11. The generator sound shield 10 is composed of six outer corner connector members 12. These corner connector members 12 connect with the rail members 20, 22, 24, 26 and 28. There are also two inner corner connector members 19 which connect with the rail members 26 and 28. These rail members provide attachment with the front panel member 30, a top panel member 32 and the end panel member 38, as well as smaller front panel 33, end panels 36 and 34 and top panel member 37. A control console 40 for a housed generator set is positioned on panel member 37. In addition, back panels (not shown) similar to panels 30 and 33 are also provided to form a box-like enclosure for a marine generator which is powered by an internal combustible engine which are not shown.

Referring to FIGS. 5–10, there is illustrated the outer connector member 12. As indicated in these Figures, the outer connector member 12 has nine locating pins 12A. Three locating pins 12A extend from each of the three faces of the connector member 12. The same pertains to the inner connector member 19 shown in FIGS. 11–16 also having three locating pins 19A extending from each of the two faces. These locating pins fit into the notches of the respective rail members. For example, there is shown in FIGS. 18, 18A–18C, rail member 24 with notches 24A, B and C which would receive three of the locating pins 12A extending from connector member 12. Rail member 24 provides two of shorter end rails. In a similar manner, three of the locating pins 12A will be received in the notches 22A, B and C of the rail 22 which provides the top rail members. The remaining three pins 12A are received in the notches 26A, B and C of rail member 26. The remaining rail members 20 and 28 are connected to the connector members 12 in a similar three directional manner.

Concerning connectors 19, they also have three locator pins 19A extending from the sides thereof. However, they extend from only two sides to make connections with rail members 26 and 28 with the locator pins 19A extending into the notches 26A, B and C and 28A, B and C.

It is seen that the horizontal rail members 22 and the vertical corner rail members 20 and 24 are of different lengths. This provides an enclosure of different heights, widths and lengths.

Figure 22:
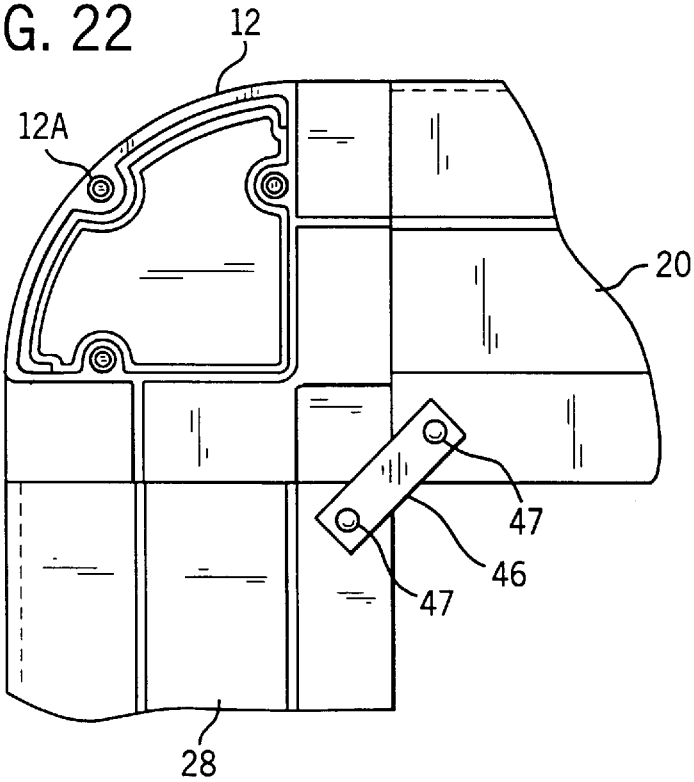
FIG. 22 is a side view in partial section illustrating the connection of rail members to the connector shown in FIGS. 5–10.
Figure 23:
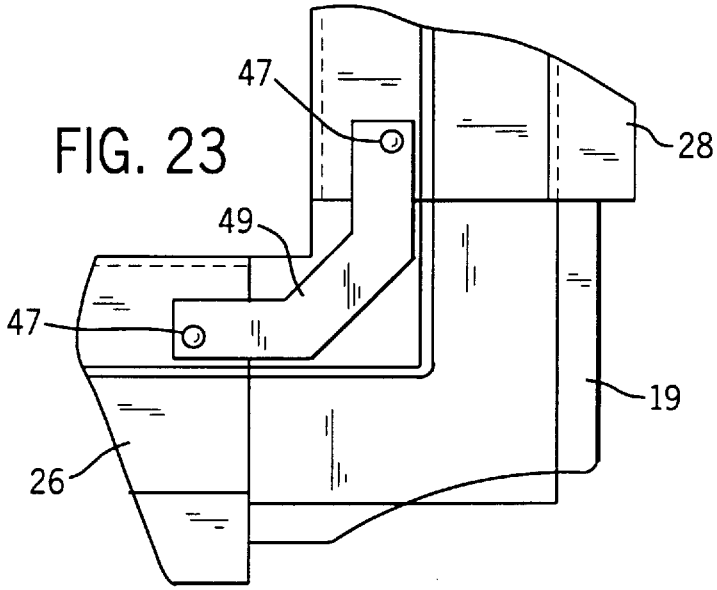
FIG. 23 is a side view illustrating the connection of rail members to the connector shown in FIGS. 11–16.

FIGS. 22 and 23 illustrate the connections between the rail members after they are positioned by the locator pins 12A and 19A of connector members 12 and 19. As shown in FIG. 22, a bracket 46 connects rail members 20 and 28 with pop rivets 47 providing a secure connection. Likewise in FIG. 23, a bracket 49 connects rail members 28 and 26 also with pop rivets 47.

Figure 21C:
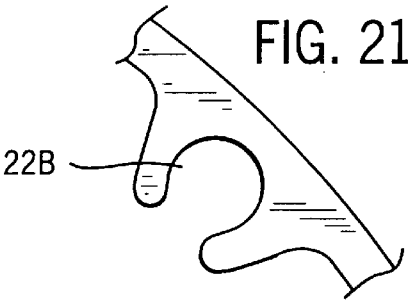
Figure 21B:
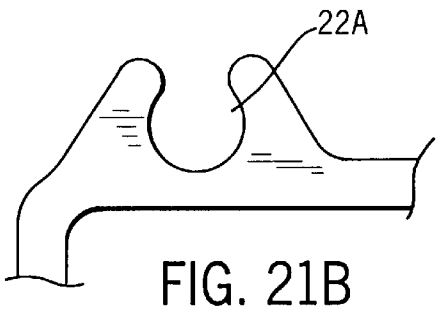
Figure 21A:
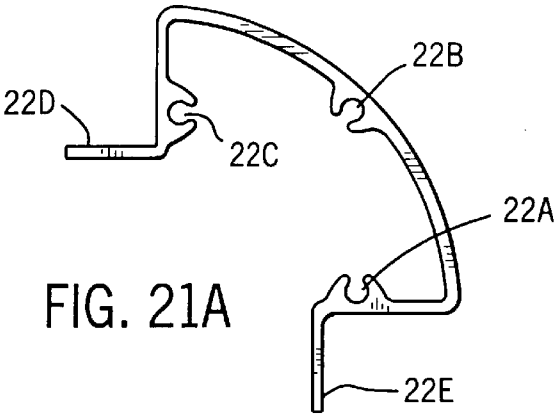
Figure 21:
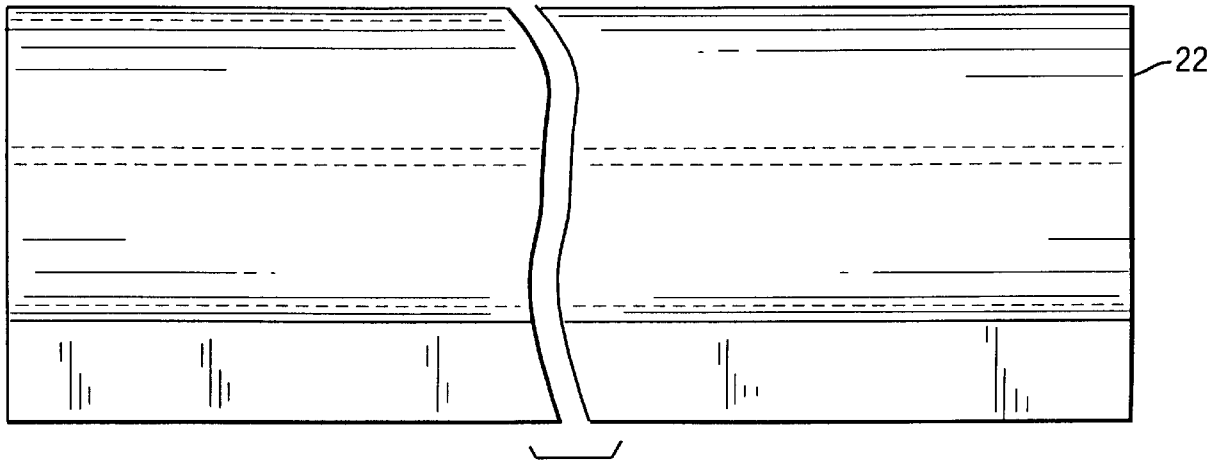

It is seen in conjunction with the drawing FIGS. 17A, 18A, 19A, 20A and 21A that there are the flange members for the rail members such as shown at 22D and 22E in conjunction with FIG. 21A. These will receive portions of the panel members for support at the ends thereof. For example, in conjunction with rail member 22, the flange 22E will receive a top portion of end panel 38, whereas the flange 22D will have a portion of top panel 32 resting thereon. In a similar manner, the rail members 20 will have the flange 20E receive the front panel 30 and the flange 20D provide a support surface for the top panel 32.

Figure 2:
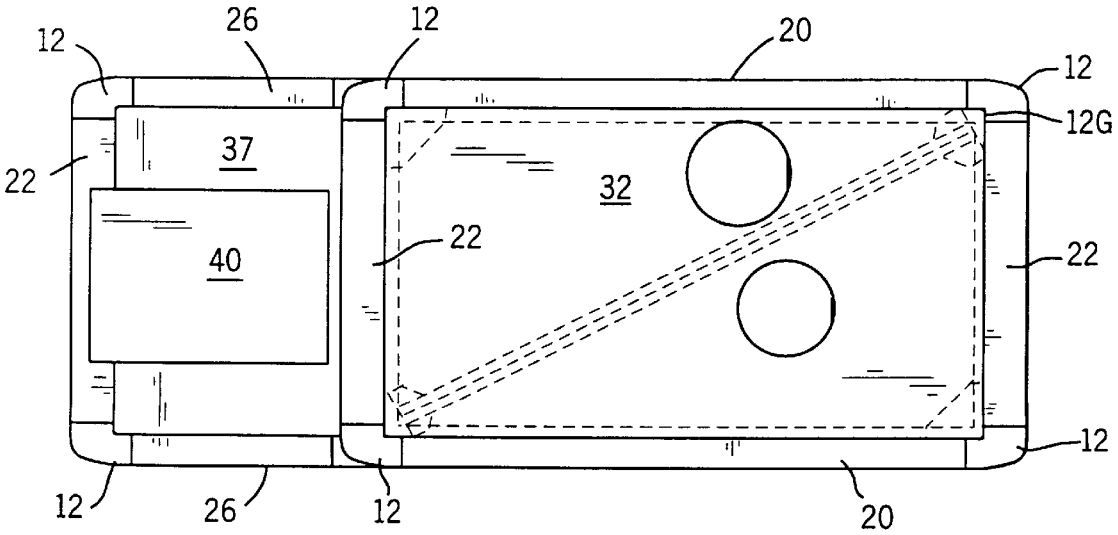
FIG. 2 is a top plan view of the generator sound shield.
Figure 3:
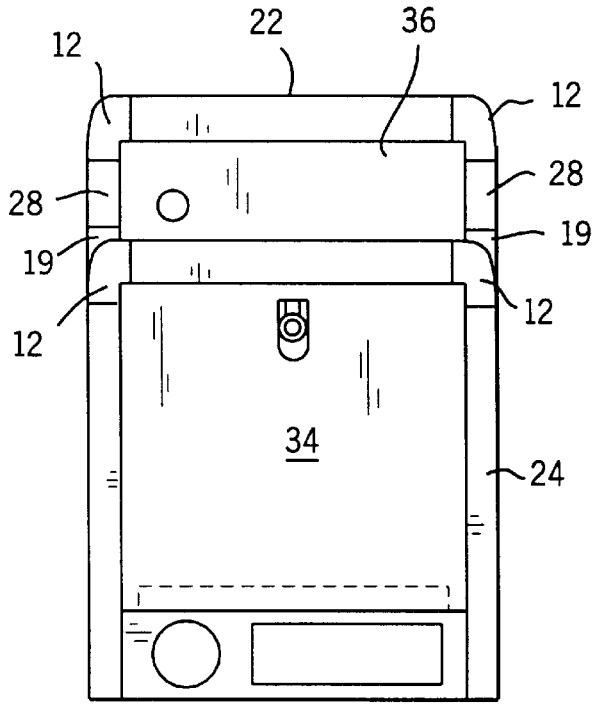
FIGS. 3 and 4 are opposing end views thereof.
Figure 4:
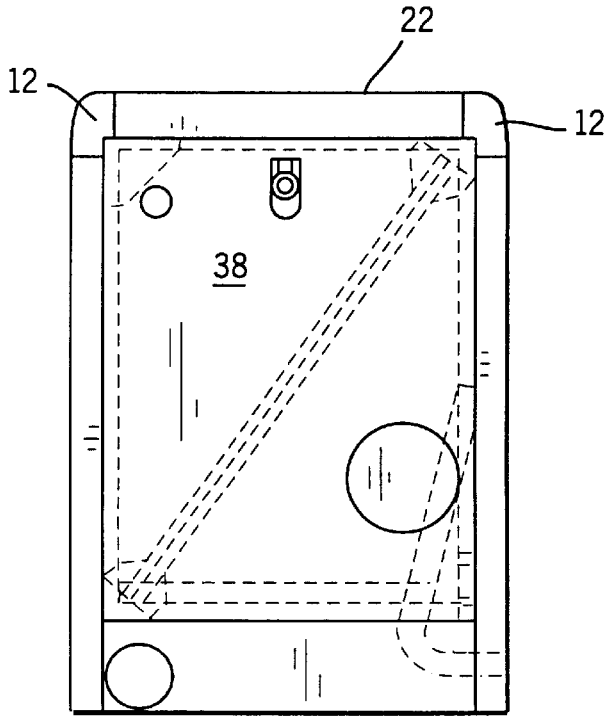
Figure 18B:
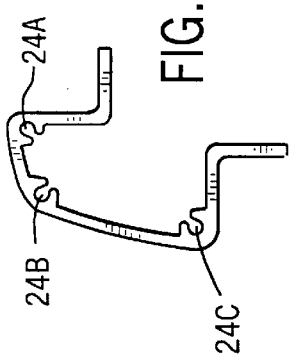
FIGS. 17, 18, 19, 20 and 21 are side views of rail members employed in conjunction with the generator sound shield shown in FIGS. 1–4.
FIGS. 17A, 18A, B and C, 19A, 20A and 21A, B and C are cross-sectional and partial employed views of the respective rail members shown in FIGS. 17–21.
Figure 18C:
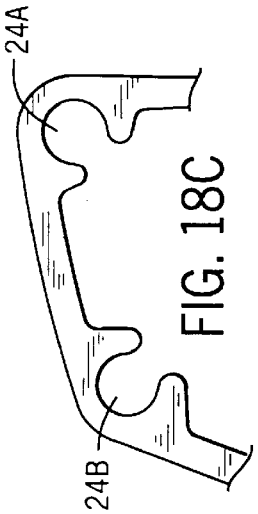
Figure 17:
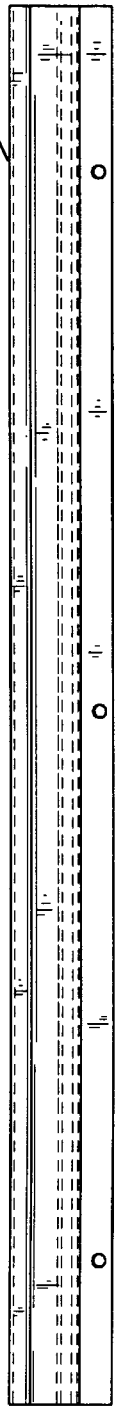
Figure 18:
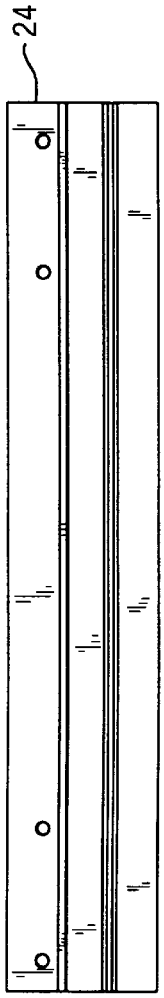
Figure 20:
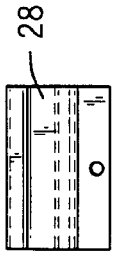
Figure 20A:
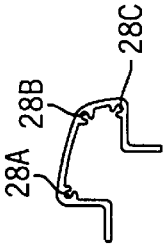
Figure 19:
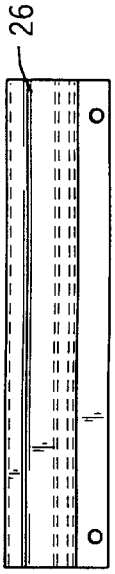
Figure 17A:
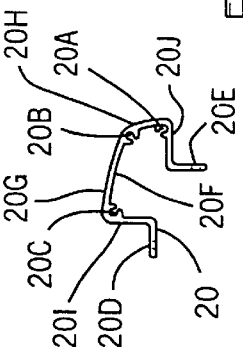
Figure 18A:
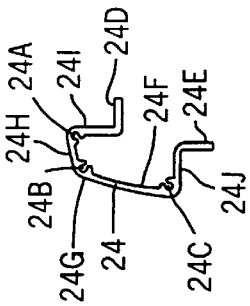
Figure 19A:
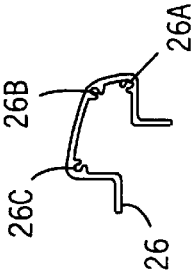

Referring back to FIGS. 5–16, it is seen that there are also flange members extending from connector members 12 and 19. These are indicated at 12C, 12D and 12E for connector member 12 and afford contact with the panel members in three different planes. They are aligned with the flanges of the rail members and provide, in conjunction with the body members of the connector members, pockets 12F and 12G for the corners of the panels such as 30 and 32, as seen in FIGS. 1 and 2. Concerning connector member 19, there are flange members 51 and 52 for abutment with panels 33 and 30 and a right angled flange member 55 for support of the opposing ends of top panel 37.

The side panels, such as 30, 34, 38, 20 and 33, are attached to the rail members such as by the latches at 44. These are available as part No. C5-11-36 from Southco., Inc. of Concordville, Pa. Braces such as 60 can also be provided for the panels such as for panels 30, 32 and 38.

While the panels are preferably secured by the latches, they can also be held in place with a screw or pop rivet. These panels can be formed from prepainted aluminum, steel, plastic, fiberglass or any other suitable material capable of structurally holding sound insulating materials. The sound insulating materials can be sprayed foam, flat sheets or pressure sensitive adhesive or loose fiberglass bats held by braces. The completed sound shield then can be assembled on the skid 11 or dropped over a generator set as a completed sound housing construction. With the prepainted panels and access doors added to the assembled frame, the sound housing is complete.

A highly attractive and pleasing appearance is provided for the generator sound shield 10 from rounded corner connector members and rail members. Rail profiles can have many end profiles to allow creating a pleasing appearance. This is seen in conjunction with FIGS. 17A and 18A wherein the rail members 20 and 24 are formed from body members 20F and 24F having an essentially C-shape with two respective slightly curved portions 20G, 20H and 24G, 24H of different lengths joined together. There are two respective straight portions 20I, 20J and 24I, 24J extending from opposing ends thereof with two flange portions 20D, 20E and 24D, 24E extending from the two straight portions.

Corner connector members can have several shapes to match the rail member profile to allow creating a pleasing appearance. Infinitely variable sound housing sizes are afforded by cutting the rail members to any desired length. Standardized corner connector members can be molded from plastic or cast from aluminum. Many varying combined rectangular sound housing shapes and sizes are possible from the combination of an inside and outside corner connector member design.

The use of smooth surfaced locating pins 12A and 19A affords a construction that can, if necessary, be easily assembled in a ship's engine room or taken apart for service. Connector pins with smooth diameters that are a tight slip fit into the rail member notches, and the attachment of the rails with brackets and pop rivets allow a sound housing construction that can be easily disassembled by drilling out the rivets. In most instances, it is not necessary to take the frame apart as the required access can be effected by removal of the top panel 32. Where additional access is required, a take apart sound housing construction is very convenient for marine, standby, prime power applications that are in tight quarters. The knock down convenience of the sound housing means a large housing can be used that would not normally fit through a small access opening. The thin flat panels, skinny rails and small corner connectors can be taken into the cramped quarters separately and assembled over the generator that is already in place. All the panels including the top can have latches which will allow easy and complete service access.

Rail members can be extruded from aluminum in long lengths and cut off to the required length which makes them inexpensive and no tooling cost. Corner connector members can be molded from plastic which makes them low cost. Plastic rails could also be employed, and corner connectors could be made from colored plastic, this allows the color to remain even if the surface is scratched or gouged. Flat side panels are easily manufactured from prepainted sheet aluminum, sheet steel, sheet plastic and or sheet fiber glass. The flat quality of the sheet material used for the side panels allows access holes to the sound housing interior to be easily manufactured and easily covered with flat matching panel shapes. Flat panels are easily sound attenuated with flat sound insulation attached with pressure sensitive adhesive. The sound housing can be a drop over design, which means it can be assembled away from the generator set and installed by dropping over it at a later time. The sounding housing can also be assembled around the generator set which can allow a smaller housing outside dimension which may be valuable in tight quarters. The rectangular frame configuration allows for standardization of the rail members and the corner connector shape. Sloped or slanted side panels although more attractive do not allow optimum part simplification and minimum part count.

Another important advantage of the invention is seen in requiring only two versions of the connector members 12 and 19 to form the complete enclosure.

Further, the rail/frame construction allows all vertical removal of side and end panels to be access points. This means maintenance service is simplified as access is offered from all four sides. In addition, the top panels can also be removed for service purposes.

While the generator sound shield has been shown in conjunction with a marine generator, it can also be employed with other portable machinery which has a tendency to create noise.

What is claimed is:

1. An acoustical enclosure for an engine generator set comprising:

a plurality of rail members constructed and arranged when assembled to form a frame for an enclosure, said rail members having notches in the ends thereof;

a plurality of connector members, at least some of the connector members having at least three sides for interconnecting ends of three of the rail members to form the frame;

connector pin members extending from at least three sides of some of the connector members for engaging the notches of the rail members in a manner to provide a slide-together connection and a slide-apart disconnection; and a plurality of panel members connected to the rail members to provide the enclosure;

whereby the acoustical enclosure can be easily assembled and disassembled in close quarters.

2. The acoustical enclosure as defined in claim 1, wherein at least one of the connector members has connector pins extending from two sides thereof.

3. The acoustical enclosure as defined in claim 1, wherein the connector pins have smooth surfaces.

4. The acoustical enclosure as defined in claim 1, wherein the horizontal rail members and the vertical corner rail members are of different lengths to provide an enclosure of different heights, widths and lengths.

5. The acoustical enclosure as defined in claim 1, wherein the connector pin members are positioned at corners of the enclosure.

6. The acoustical enclosure as defined in claim 5, wherein the connector pin members include flange sections for contact with the panel members.

7. The acoustical enclosure as defined in claim 6, wherein at least one of the connector members having three sides has three flange sections for contact with panel members in three different planes.

* * * * *